US007311576B2

(12) United States Patent
Pope

(10) Patent No.: US 7,311,576 B2
(45) Date of Patent: Dec. 25, 2007

(54) ADJUSTABLE WATERCRAFT FIN APPARATUS AND METHOD HAVING THREE DEGREES OF FREEDOM

(76) Inventor: Karl D. Pope, 605 Pope La., Ojai, CA (US) 93023

( * ) Notice: Subject to any disclaimer, the term of this patent is extended or adjusted under 35 U.S.C. 154(b) by 249 days.

(21) Appl. No.: 11/042,573

(22) Filed: Jan. 25, 2005

(65) Prior Publication Data

US 2006/0166576 A1 Jul. 27, 2006

(51) Int. Cl.
*B63B 1/00* (2006.01)

(52) U.S. Cl. ..... 441/79; 114/140

(58) Field of Classification Search ..... 441/79; 114/140–143

See application file for complete search history.

(56) References Cited

U.S. PATENT DOCUMENTS 5,503,581 A * 4/1996 McCullough ..... 441/79
6,244,921 B1 6/2001 Pope
6,752,674 B2 * 6/2004 Jolly ..... 441/79
2006/0035543 A1 * 2/2006 English et al. ..... 441/79

* cited by examiner

*Primary Examiner*—Ed Swinehart
(74) *Attorney, Agent, or Firm*—Lyon & Harr, LLP; Craig S. Fischer

(57) ABSTRACT

The three-degree of freedom fin apparatus and method described herein is for use on a watercraft (such as a surfboard) and allows adjustment of up to three degrees of freedom, including a translational degree of freedom along a longitudinal axis of the fin structure in the fore and aft direction (longitudinal translation or pitch), a first rotational degree of freedom about the longitudinal axis (roll), and a second rotational degree of freedom about a vertical axis centered at a point on the fin (yaw). Pitch adjustment is made by sliding a base plate and fin assembly along the longitudinal axis. Yaw adjustment is made by moving a front portion of the fin assembly about a yaw pivot point and the rear portion along a yaw track in the base plate. A roll adjustment is made by rotating a fin unit of the fin assembly about the longitudinal axis.

13 Claims, 7 Drawing Sheets

ADJUSTABLE WATERCRAFT FIN APPARATUS AND METHOD HAVING THREE DEGREES OF FREEDOM

TECHNICAL FIELD

The present invention relates in general to a fin apparatus and method for use on a watercraft (such as a surfboard) and more particularly to an adjustable fin structure having three degrees of freedom including a translational degree of freedom along a longitudinal axis of the fin in the fore and aft direction (longitudinal translation or pitch), a first rotational degree of freedom about the longitudinal axis (roll), and a second rotational degree of freedom about a vertical axis centered at a point on the fin (yaw).

BACKGROUND OF THE INVENTION

Surfing in a popular sport in many parts of the world. Surfing generally involves a surfer riding a wave while upright on a surfboard. The surfer is able to control the surfboard by positioning himself at different locations on the surfboard and by varying his center of gravity. The surfboard (and other types of watercraft) typically have one or more fins or skegs located on the underside of the surfboard. These fins are designed to guide and steer the surfboard through the water. Many surfboards are designed and manufactured such that the fins are fixed in place and cannot be adjusted.

One drawback to the fixed fin configuration of conventional surfboards is that oftentimes a surfer (especially a professional surfer) will want to customize a surfboard to achieve desired surfing characteristics. The most direct way to "fine tune" or customize their surfboard is by adjusting the fins. Adjustment of the fins fine tunes the performance of the surfboard to achieve a desired customization. However, the fixed configuration of conventional fins prevents a surfer from adjusting the fins to correct or vary surfboard characteristics.

One way that has been tried to overcome this problem is to set a roll angle of the fins to a preset position during the manufacturing process. The roll angle is the angular displacement of the fin relative to a longitudinal axis of the fin, where the longitudinal axis is in a fore and aft direction. By adjusting the roll angle of the fins, the surfer can obtain at least some of the desired performance characteristics from the surfboard. In theory, the surfer sets forth the surfing characteristics desired from the surfboard, the manufacturer adjusts the fin roll angle to achieve the desired performance, and the fins are fixed into the desired position. In practice, however, a desired fin alignment is difficult to keep during the manufacturing process. Even if the roll angle is as desired when the fin is first mounted, this angle may shift as the manufacturing process progresses. Properly aligning the roll angle of the fins is even more difficult when there are multiple fins. For example, the roll angle of multiple fins (such as a side-by-side configuration) typically must be aligned with respect to each other. Since the fins are fixed, any misalignment in roll angle cannot be corrected and a mistake in aligning even one of the fins may ruin the entire surfboard.

A partial solution to this problem was described in U.S. Pat. No. 6,244,921 to Karl D. Pope entitled "Fin Attachment System Allowing Roll Angle Alignment" filed on Jan. 24, 2000 and issued on Jun. 12, 2001. In the '921 patent, the solution was to provide a means for full adjustment of the fin roll angle about a longitudinal axis. However, the '921 patent only provides adjustment in one degree of freedom.

Namely, only the roll angle of the fin is adjustable. This can make it difficult to fully achieve the desired surfboard characteristics. Thus, what is needed is an adjustable fin apparatus and method having adjustment in other degrees of freedom including the roll angle to allow fine tuning of desired performance characteristics.

SUMMARY OF THE INVENTION

The three-degree of freedom fin apparatus and method described herein is designed to allow adjustment of a fin structure in three degrees of freedom. This allows the fine tuning of desired performance characteristics for a watercraft. In a preferred embodiment, the watercraft is a surfboard.

In general, the three-degree of freedom fin structure provides a way to adjust the fin structure in one translational and two rotational degrees of freedom. Specifically, the fin structure provides adjustment in a translational degree of freedom along a longitudinal axis of the fin structure in the fore and aft direction (longitudinal translation or pitch), a first rotational degree of freedom about the longitudinal axis (roll), and a second rotational degree of freedom about a vertical axis centered at a point on the fin (yaw). The fin structure includes a roll means that is used to adjust the roll of the fin structure to a desired roll, and an adjusting means for adjusting at least one of the other degrees of freedom.

The pitch means includes a base plate having a pitch track that is a void or cut-out. A slider assembly fits partially through the pitch track, such that tabs of the slider assembly project from a bottom of the base plate and a slider plate is disposed on a top of the base plate. The tabs are used to secure the fin structure to the watercraft (such as a surfboard) in a removable fashion. The pitch means also includes a fin unit having a fin and a fin cylinder. The fin unit is part of a fin assembly. The fin assembly is fastened to the top of the base plate over the slider assembly. This allows the base plate and fin assembly as a unit to slide back and forth along the longitudinal axis. By sliding the base plate and fin assembly fore and aft while the fin structure is secured to the surfboard, a desired pitch of the fin structure can be achieved.

The yaw means includes a yaw track that is a void or cut-out in an aft portion of the base plate. In addition, a yaw pivot point is positioned on a front portion of the base plate. The fin assembly fastened to the base plate at these two locations. In particular, a rotatable fastening means is used to fasten the fin assembly to the base plate at the yaw pivot point. This fastening is such that the fastening means can be unlocked to allow the fin assembly to rotate about a vertical axis going through the center of the yaw pivot point. A slidable fastening means is used to fasten the fin assembly to any point on the yaw track. The slidable fastening means can be unlocked to allow an aft portion of the fin assembly to be slid along the yaw track to achieve a desired yaw. Once the desired yaw is reached, both the rotatable fastening means and the slidable fastening means may be locked to hold the desired yaw.

The roll means includes a middle plate of the fin assembly. The middle plate has a roll track, which is a groove cut in a top of the middle plate. The roll track is designed to cradle the fin unit such that the fin unit is able to rotate about the longitudinal axis. The fin unit is held in place on the roll track by two end caps. Namely, a fore end cap is located on a front portion of the fin cylinder and an aft end cap is located on a rear portion of the fin cylinder. The two end caps are secured to the middle plate such that the fin unit can roll about the longitudinal axis. The fin unit can be adjusted to achieve a desired roll angle. Once the desired roll is achieved, the roll locking means is used to hold the fin unit in place at the desired roll.

The three-degree of freedom fin adjustment method uses the fin structure to achieve desired performance characteristics of the surfboard. In general, the method includes adjusting a roll of the fin structure and adjusting at least one of degree of freedom of the fin structure. More specifically, the fin structure is provided with three-degree of freedom adjustability, using the above-described fin structure. Next, it is determined whether the roll of the fin structure is to be adjusted. If so, then the roll is adjusted by rotating the fin unit about the longitudinal axis.

A determination then is made as to whether the yaw of the fin structure is to be adjusted. If so, then the yaw is adjusted by rotating the fin assembly around the yaw pivot point until the desired yaw is achieved. Next, it is determined whether the pitch of the fin structure is to be adjusted. If so, then the pitch is adjusted by sliding the fin assembly and base plate together along the longitudinal axis until the desired pitch is achieved.

BRIEF DESCRIPTION OF THE DRAWINGS

The present invention can be further understood by reference to the following description and attached drawings that illustrate aspects of the invention. Other features and advantages will be apparent from the following detailed description of the invention, taken in conjunction with the accompanying drawings, which illustrate, by way of example, the principles of the present invention.

Referring now to the drawings in which like reference numbers represent corresponding parts throughout.

DETAILED DESCRIPTION OF THE INVENTION

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

Figure 1:
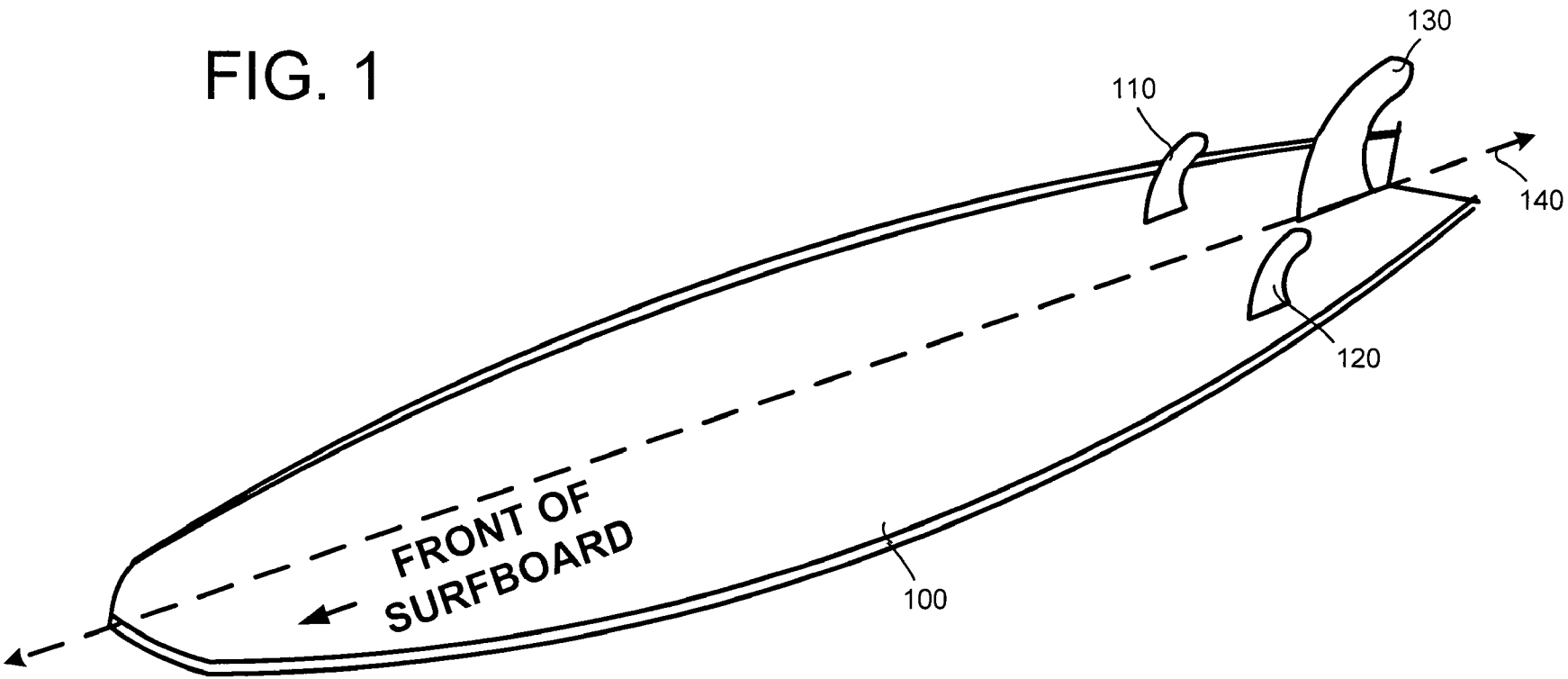
FIG. 1 illustrates a perspective view of an exemplary embodiment of the three-degree of freedom fin structure and method installed on an underside of a surfboard.

The adjustable three-degree of freedom fin structure and method described herein is designed operate on a watercraft. FIG. 1 illustrates a perspective view of an exemplary embodiment of the three-degree of freedom fin structure and method installed on an underside of a surfboard 100. In general, the adjustable three-degree of freedom fin structure and method attaches to the surfboard 100 and allows adjustment by a user in one translational degree of freedom and two rotational degrees of freedom. Specifically, referring to FIG. 1, the surfboard 100 includes an underside surface (shown) containing three fin structures attached thereon. The three fin structures include a first fin structure 110, a second fin structure 120, and a main fin structure 130. The adjustable three-degree of freedom fin structure can be incorporated into any or all of the fin structures 110, 120, 130. In this exemplary embodiment, the adjustable three-degree of freedom fin apparatus is incorporated into the first fin structure 110, the second fin structure 120, and the main fin structure 130.

As shown in FIG. 1, the fin structures 110, 120, 130 are disposed at the underside rear of the surfboard 100 about a main longitudinal axis 140 of the surfboard 100. In FIG. 1, the front of the surfboard 100 is to the left of the FIG. 1 and the rear is to the right. The main longitudinal axis 140 runs along the length of the surfboard 100, from the front to the rear, and as shown in FIG. 1, bisects the surfboard 100 in the direction perpendicular to the main longitudinal axis 140.

II. Three-Degree of Freedom Fin Structure

The three-degree of freedom fin structure described herein allows adjustment of the entire fin structure in one or all of three degrees of freedom. These three degrees of freedom include a translational degree of freedom along a longitudinal axis of the fin in the fore and aft direction (longitudinal translation), a first rotational degree of freedom about the longitudinal axis (roll), and a second rotational degree of freedom about a vertical axis centered at a point on the fin (yaw). The three-degree of freedom fin structure removably attaches to the surfboard 100 and allows a surfer to fine tune the surfboard 100 via one, two, or all of the fin structures 110, 120, 130. In this manner, the desired performance characteristics of the surfboard 100 can be achieved.

Figure 2:
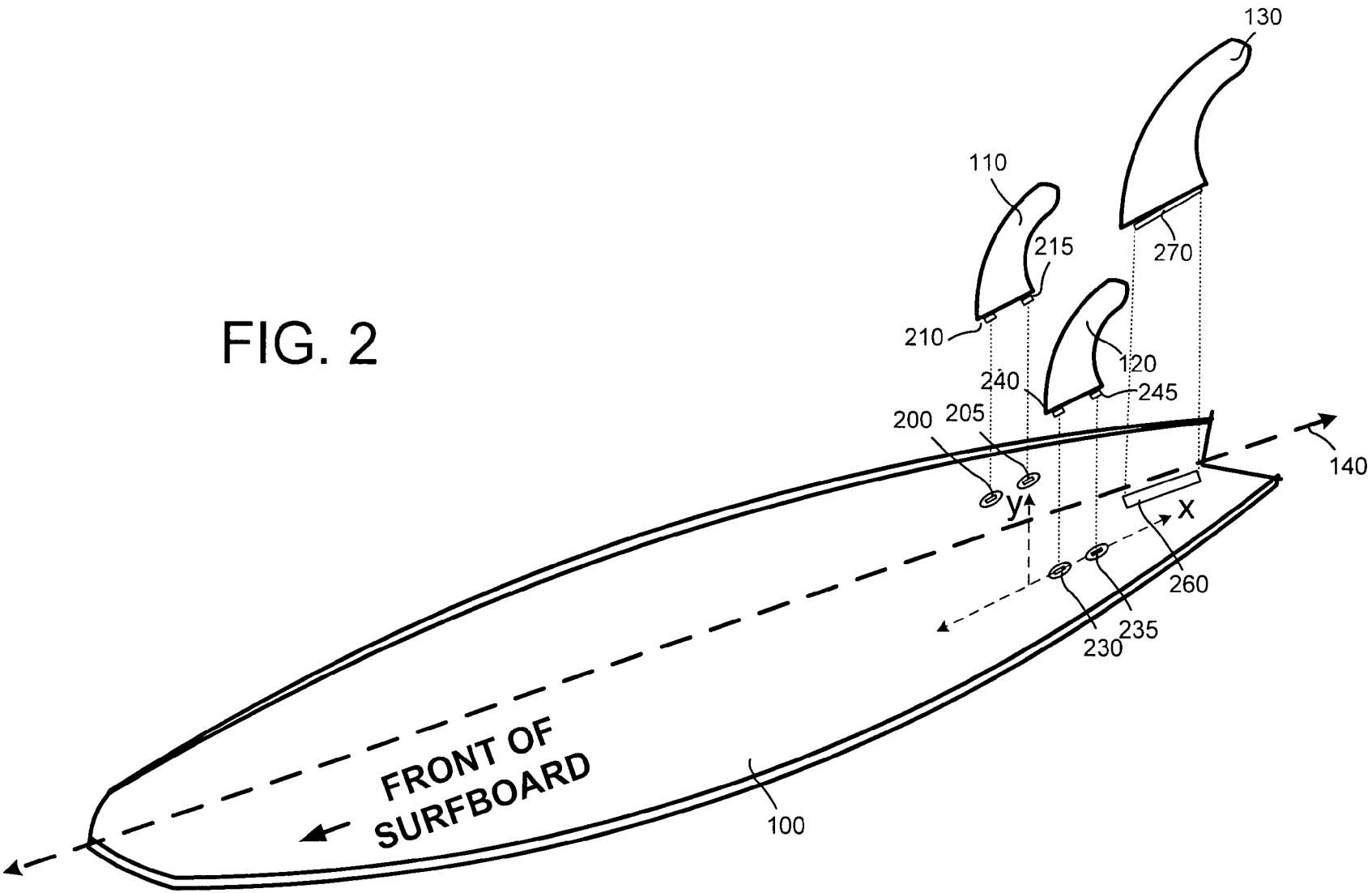
FIG. 2 illustrates how the three-degree of freedom structures attach to the surfboard of the exemplary embodiment shown in FIG. 1.

FIG. 2 illustrates how the three-degree of freedom structures 110, 120, 130 attach to the surfboard 100 of the exemplary embodiment shown in FIG. 1. In general, the fin structures 110, 120, 130 are removable attached to the surfboard using a removable fin system, such as those manufactured by Fin Control Systems (FCS), Future Systems, and O'FISH'L. Each of the fin structures 110, 120, 130 has an associated removable fin system. In particular, referring to FIG. 2, the surfboard 100 includes a removable fin system for the first fin structure 110 including a first fore fin box 200 and a first aft fin box 205. These two fin boxes 200, 205 are attached flush to the underside of the surfboard 100. The removable fin system for the first fin structure 110 also includes a first fore tab 210 and a first aft tab 215. Both of these tabs 210, 215 are part of the first fin structure 110. Each of the fin boxes 200, 205 includes at least one set screw set angled such that the set screw is capable of engaging and holding the tabs 210 215 in place. Alternatively, the fin boxes 200, 205 may contain some other type of removably fastening means for holding the tabs 210, 215 in place within the fin boxes 200, 205.

Similarly, the removable fin system for the second fin structure 120 includes a second fore fin box 230 and a second aft fin box 235, disposed on the surfboard 100. The removable fin system also includes on the second fin structure 120 a second fore tab 240 and a second aft tab 245. In addition, the removable fin system for the main fin structure 130 includes a main fin box 260. The removable fin system for the main fin structure 130 also includes a main tab 270 disposed on the main fin structure 130. As shown by the dashed line in FIG. 2, the first fore tab 210 inserts in the first fore fin box 200 and the first aft tab 215 inserts in the first aft fin box 205 to secure the first fin structure 110 in position on the surfboard 100. Likewise, the second fin structure 120 and the main fin structure 130 are secured in place on the surfboard 100 by inserting the each of the tabs 240, 245, 270 in the corresponding fin boxes 230, 235, 260. Set screws (or alternatively, some other type of removably fastening means) are used to engage the tabs 240, 245, 270 such that the tabs 240, 245, 270 are held firmly in place by tightening the set screws or the tabs 240, 245, 270 may be removed by loosening the set screws. In this manner, the fin structures 110, 120, 130 are removable attached to the surfboard 100 for easy removal when necessary or desired (such as when traveling with the surfboard).

FIG. 2 also illustrates an orientation of an axes that will be used to further describe the three-degree of freedom fin structure. Specifically, a longitudinal axis is labeled in FIG. 2 as the x-axis. The longitudinal axis is oriented parallel to the main longitudinal axis 140. A vertical axis is labeled as the y-axis, and is perpendicular to the longitudinal axis in a direction away from the surfboard 100.

Figure 3:
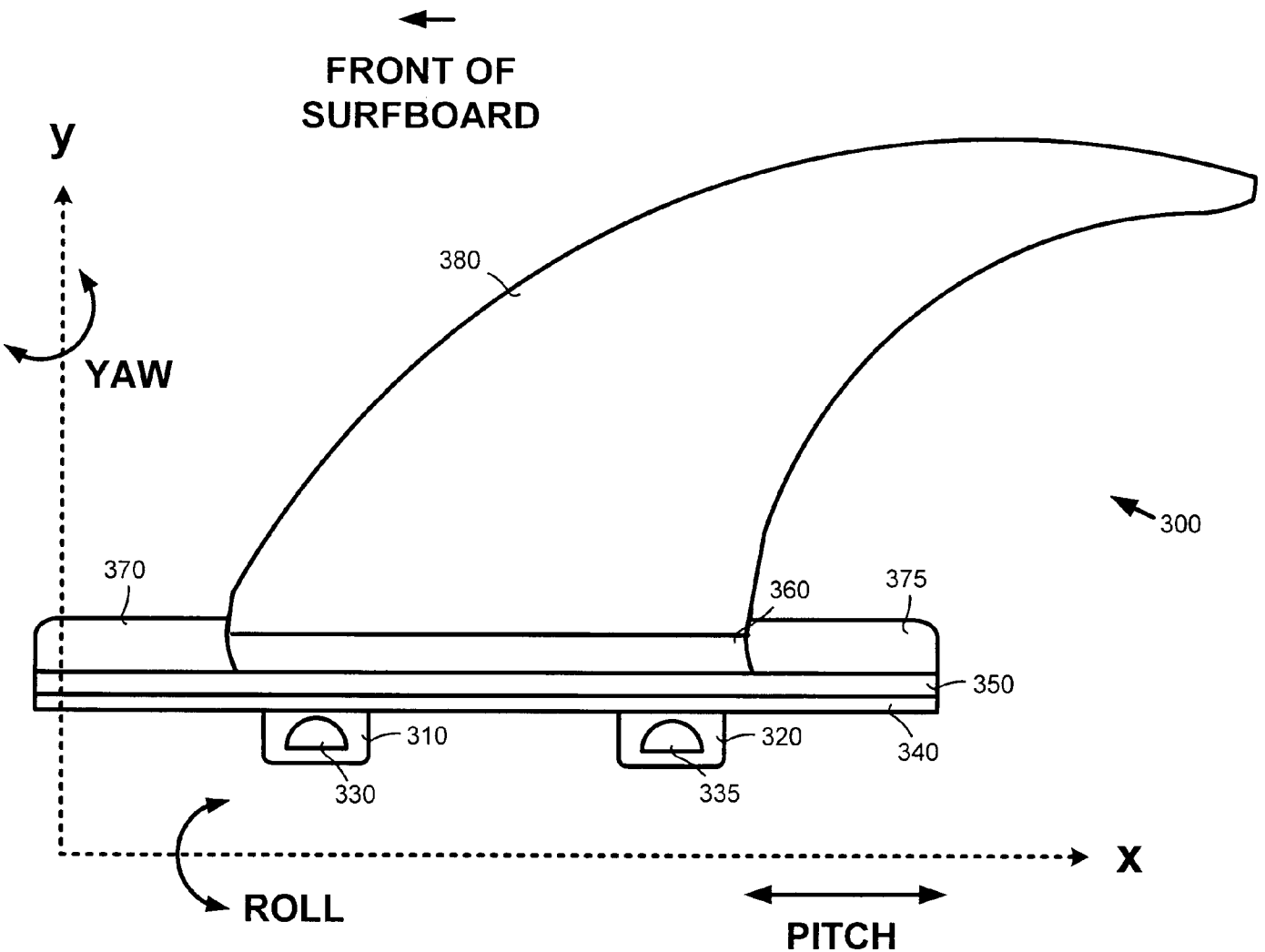
FIG. 3 illustrates a side view of the three-degree of freedom fin structure shown in FIGS. 1 and 2.

FIG. 3 illustrates a side view of the three-degree of freedom fin structure 300 shown in FIGS. 1 and 2. It should be noted that the fin structures 110, 120, 130 are exemplary implementations of the three-degree of freedom fin structure 300 shown in FIG. 3. Referring to FIG. 3, the three-degree of freedom fin structure 300 includes a fore tab 310 and an aft tab 320. As explained above with regard to FIG. 2, the tabs 310, 320 are part of a removable fin system that removably attaches the three-degree of freedom fin structure 300 to the surfboard 100. The fore tab 310 includes a first depression 330 and the aft tab 320 includes a second depression 335. The depressions 330, 335 are used to engage set screws (not shown) when attaching the three-degree of freedom fin structure 300 to the surfboard 100.

The three-degree of freedom fin structure 300 also includes a base plate 340 and a middle plate 350. The middle plate 350 is disposed above the base plate 340. A fin cylinder 360 is disposed partially within the middle plate 350 and is held in place by a fore end cap 370 and an aft end cap 375. The fore end cap 370 and the aft end cap 375 are attached to a fore and an aft end of the middle plate 350. A fin 380 is attached to the fin cylinder 360 and is positioned such that the fin 380 is not covered by either of the end caps 370, 375.

A portion of the fin structure 300 is capable of being made to rotate about the longitudinal axis (or x-axis). This is also known as a first rotational degree of freedom about the longitudinal axis, and is designated in this specification as a "roll" of the three-degree of freedom fin structure 300. The three-degree of freedom fin structure 300 also has a translational degree of freedom along the longitudinal axis. This longitudinal translation is in the fore and aft direction along the x-axis. In this specification, this is designated as longitudinal translation, or "pitch". The fin structure 300 also has a second rotational degree of freedom about the vertical axis. This is designated in this specification as the "yaw". The yaw is centered at a point on the fin structure 300 that goes through the fore portion of the fin structure 300. The point about which the yaw is centered will be discussed in detail below.

III. Component Details

Figure 4:
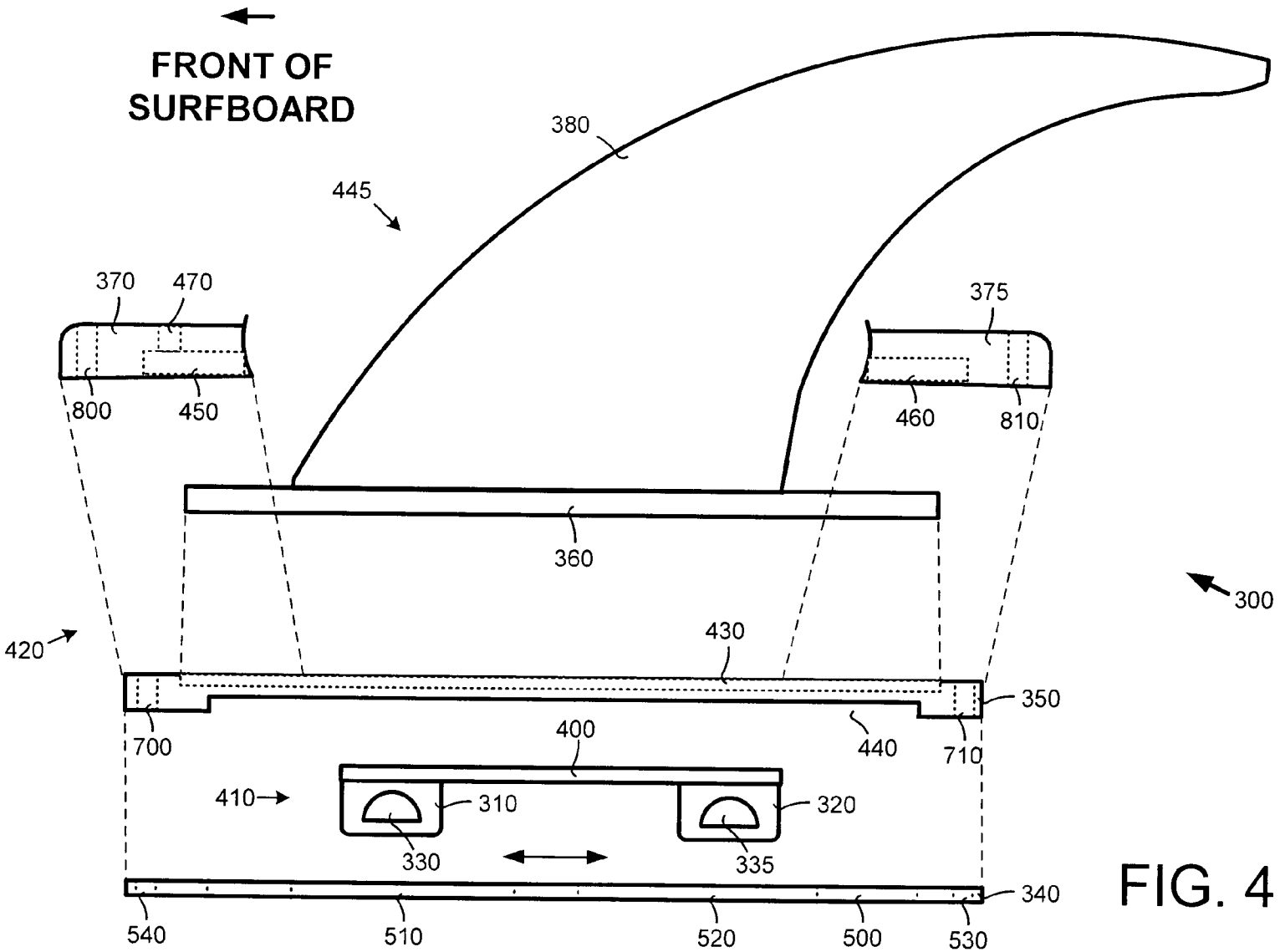
FIG. 4 illustrates an exploded side view of the three-degree of freedom fin structure shown in FIG. 3.

The details of the three-degree of freedom fin structure 300 and its components will now be discussed. FIG. 4 illustrates an exploded side view of the three-degree of freedom fin structure 300 shown in FIG. 3. The tabs 310, 320 are connected via a slider plate 400. As shown in FIG. 4, each of the tabs 310, 320 are attached at either end of the slider plate 400 and at an underside or bottom of slider plate 400. In other words, the slider plate 400 has the tabs 310, 320 attached at opposite ends of the bottom of the slider plate 400. Together, the slider plate 400 and tabs 310, 320 make up a slider assembly 410. The slider assembly is capable of being attached to the surfboard while the remainder of the three-degree of freedom fin structure 300 slides in the fore and aft direction parallel to the longitudinal axis (or x-axis) of the structure 300.

Figure 5:
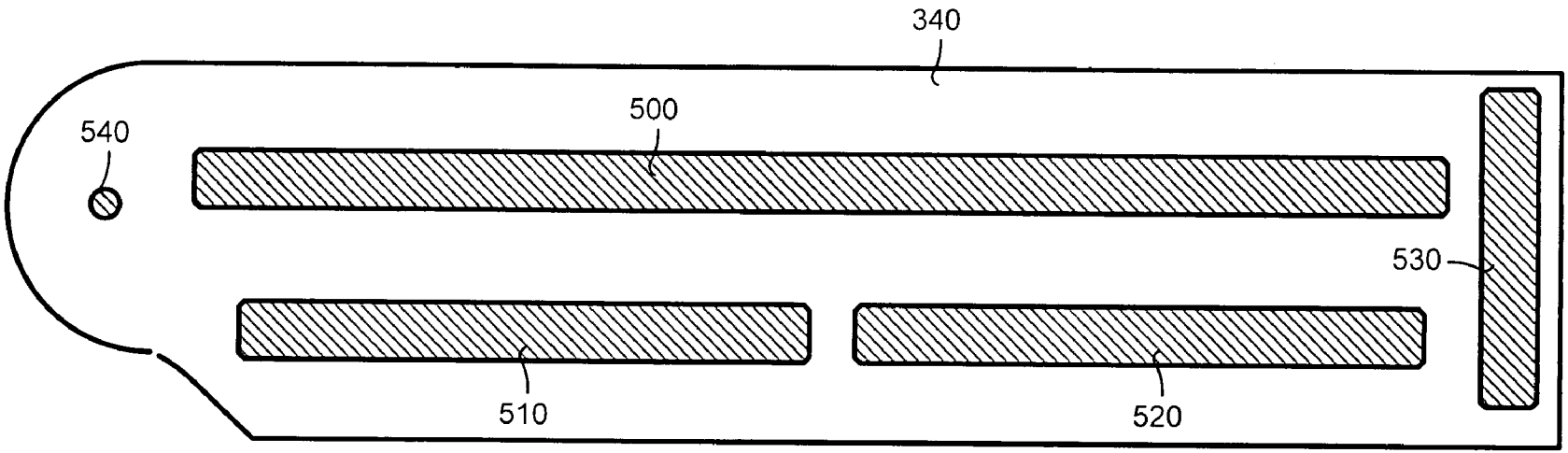
FIG. 5 illustrates a top view showing the details of the base plate.
Figure 6:
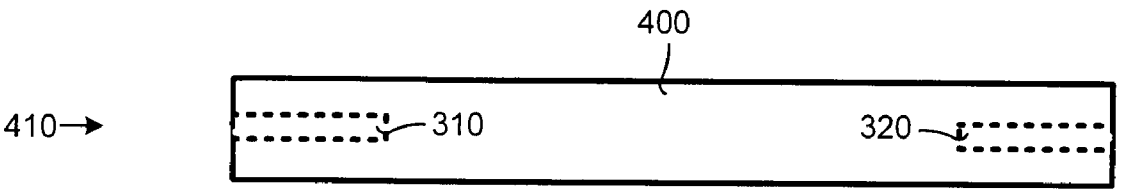
FIG. 6 illustrates a top detailed view of the slider assembly.

FIG. 5 illustrates a top view showing the details of the base plate 340. The base plate 340 includes a pitch track 500, which is a void or cut-out in the base plate 340. The width of the pitch track 500 is slightly wider that than the width of the tabs 310, 320. Referring also to FIG. 4, this allows the tabs 310, 320 of the slider assembly 410 to be inserted through the base plate 340 such that the tabs 310, 320 go through the base plate 340 but the slider plate 400 rides on top of the base plate 340. FIG. 6 illustrates a top detailed view of the slider assembly 410, including the slider plate 400 and the fore tab 310 and the aft tab 320.

As shown in FIG. 5, the base plate 340 also includes access voids for accessing the set screws on the fin boxes for holding the tabs. In particular, a fore access void 510 is used to access set screws (or other removably fastening means), such as the set screws of the first fore fin box 200, and an aft access void 520 to access other set screws (or other removably fastening means), such as of the aft fin box 205.

The base plate 340 also includes a yaw track 530, which is a void or cut-out in the base plate 340. In addition, the base plate 340 includes a yaw pivot point 540 about which the three-degree of freedom fin structure 300 rotates. The fin structure 300 rotates about the vertical axis (or y-axis). In FIG. 5, the vertical axis about which the fin structure 300 yaws comes straight out of the paper through a center of the yaw pivot point 540.

Referring to FIG. 4, a fin assembly 420 includes the middle plate 350, the fin cylinder 360, the fore end cap 370, the aft end cap 375, and the fin 380. The fin cylinder 360 fits inside a roll track 430 of the middle plate 350. The roll track 430 is a groove cut in the middle plate 350 that allows approximately half a thickness of the fin cylinder 360 to be disposed or sit in the middle plate 350. The middle plate 350 also includes a pitch void 440 that is cut-out of the bottom of the middle plate 350. This allows the middle plate 350 to fit over the slider assembly 410 and attach to the base plate 340.

In a preferred embodiment, the fin cylinder 360 and the fin 380 are a one-piece unit. Referring to FIG. 4, the combination of the fin cylinder 360 and the fin 380 make up a fin unit 445. The fin unit 445 is capable of rotating about the longitudinal axis while disposed on the roll track 430. This allows the fin unit to be rotated to set a desired roll of the fin structure 300. It should be noted that the bounds of the roll are set by the middle plate 350.

Figure 7:
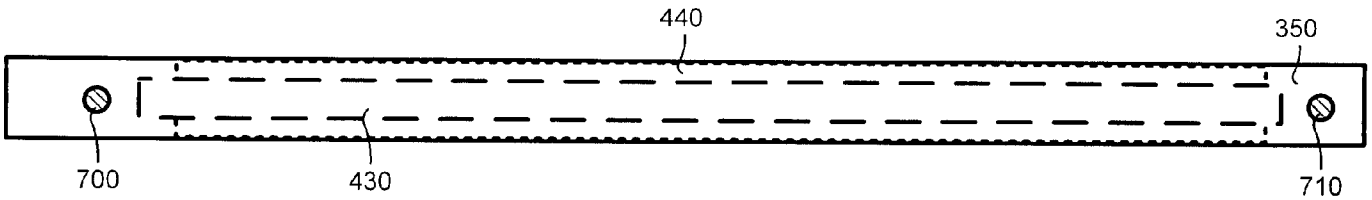
FIG. 7 illustrates a top view of the middle plate.

FIG. 7 illustrates a top view of the middle plate 350. The middle plate 350 includes the roll track 430 and the pitch void 440. In addition, the middle plate 350 includes a first middle plate hole 700 that allows attachment of the fin assembly 420 to the base plate 340 at the yaw pivot point 540. The middle plate 350 also includes a second middle plate hole 710 that allows the fin assembly 420 to be slidably attached to the base plate 340.

Referring again to FIG. 4, the fin unit 445 is held in the middle plate 350 by the fore end cap 370 and the aft end cap 375. The fore end cap 370 includes a first end cap hole 800 that is used to rotatably attach the fore end cap 370 to the middle plate 350 and, in turn, to the base plate 340. The fore end cap 370 also includes a fore fin cylinder cutout 450 that allows the fore end cap 370 to fit over a front portion of the fin cylinder 360. The aft end cap 375 includes a second end cap hole 810 that is used to slidably attach the aft end cap 375 to the middle plate 350 and, in turn, to the base plate 340. The aft end cap also includes an aft fin cylinder cutout 460 that allows the aft end cap 375 to fit over an aft portion of the fin cylinder 360. In addition, a roll locking hole 470 allows a locking means to be tightened or loosened to either lock or unlock the rotation of the fin unit 445. In a preferred embodiment, the locking means is a set screw.

The entire fin assembly 420 is attached to the base plate 340 with the slider assembly 410 sandwiched in between. The fin assembly 420 is rotatably attached at the front of the base plate 340 and slidably attached at the rear of the base plate 340. The fin assembly 420 is rotatably attached to the base plate 340 by using a rotatable fastening means. In preferred embodiment, a screw is used to fit through the first end cap hole 800, the first middle plate hole 700, and attach to the base plate at the yaw pivot point 540. This rotatable attachment allows the fin assembly 420 to rotate about the yaw pivot point 540 and in order for a surfer to adjusts the yaw of the three-degree of freedom fin structure 300. The fin assembly 420 is slidably attached to the base plate 340 by using a slidable fastening means. In a preferred embodiment, a screw is used to fit through the second end cap hole 810, the second middle plate hole 710, and slidably attach to the base plate 340.

Figure 8:
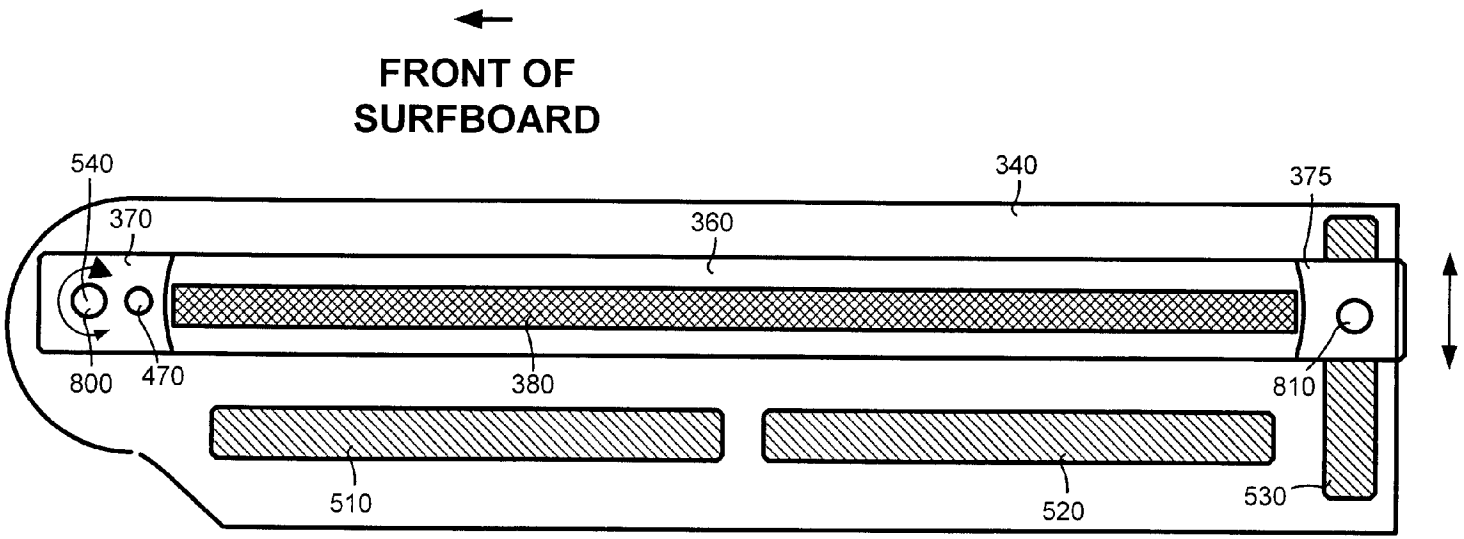
FIG. 8 illustrates a top view of the fin assembly and base plate attachment.

FIG. 8 illustrates a top view of the fin assembly 420 and base plate 340 attachment. As describe above, the fin assembly 420 is rotatably attached to the base plate 340 at the yaw pivot point 540 using the first end cap hole 800. The fin assembly 420 is slidably attached to the base plate 340 using the second end cap hole 810. When loosened, the fin assembly 420 slides side to side along the yaw track 530 until the desired yaw is found. The yaw then is set by tightening the rotatable fastening means at the first end cap hole 800 and the slidable fastening means at the second end cap hole 810.

IV. Operational Overview

Figure 9:
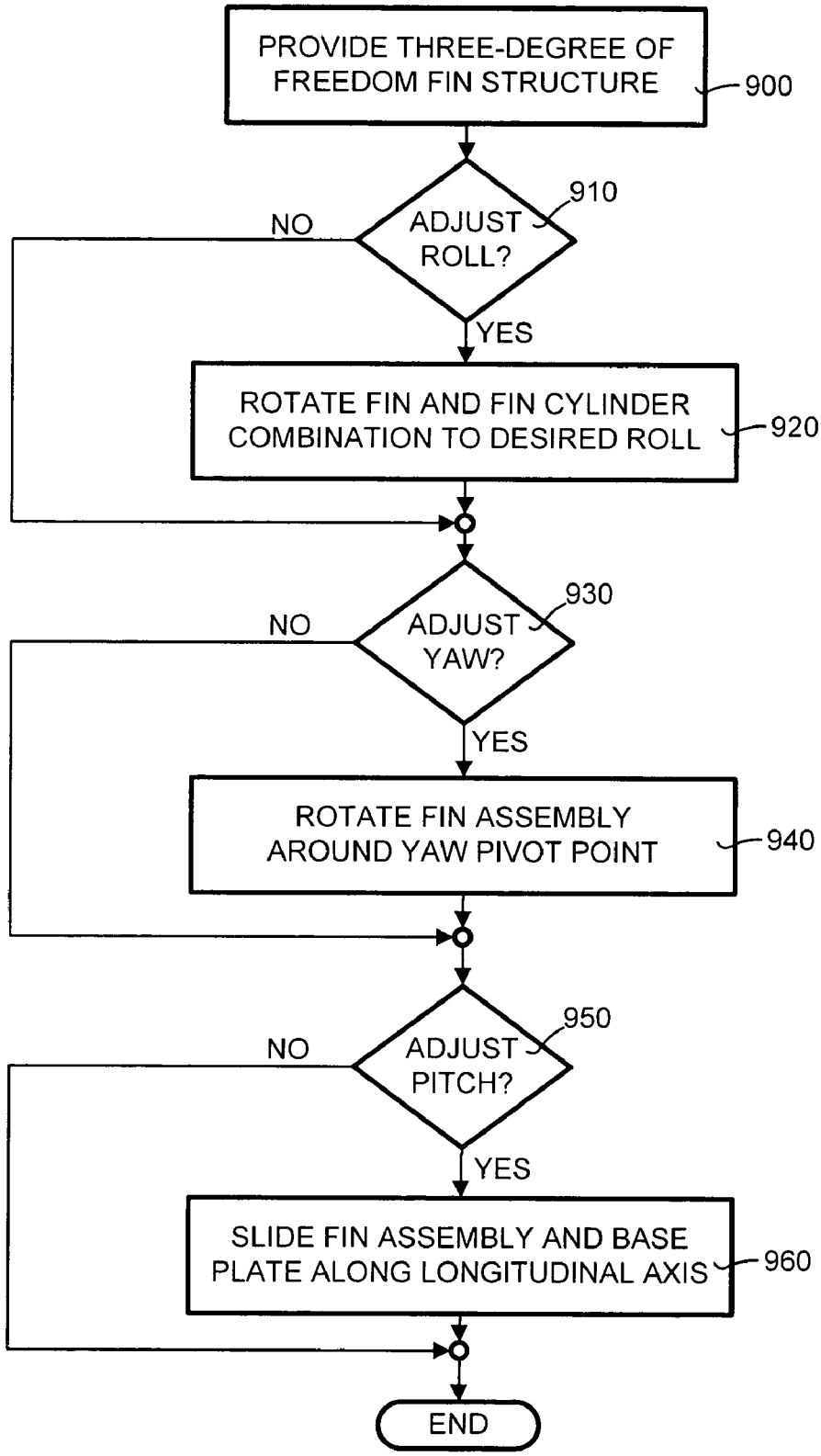
FIG. 9 is a general flow diagram illustrating the three-degree of freedom fin structure adjustment method.

The three-degree of freedom fin structure 300 and method described herein allow adjustment of the fin 380 in one transitional degree of freedom and two rotational degrees of freedom. FIG. 9 is a general flow diagram illustrating the three-degree of freedom fin structure adjustment method. The method starts with providing the three-degree of freedom fin structure 300 discussed above (box 900). Next, it is determined whether the roll is to be adjusted (box 910). If so, then the roll is adjusted by rotating the fin unit 445, including the fin 380 and fin cylinder 360 (box 920). If not, then it is determined whether the yaw is to be adjusted (box 930). If so, then the yaw is adjusted by rotating the fin assembly 420 around the yaw pivot point 540 until the desired yaw setting is reached (box 940). If not, then it is determined whether the pitch is to be adjusted (box 950). If so, then the pitch is adjusted by moving the fin assembly 420 and base plate 340 combination forward or backward until the desired pitch is achieved (box 960). Otherwise, the method ends (box 970).

More specifically, in a preferred embodiment, the roll of the three-degree of freedom fin structure 300 is adjusted by loosening a set screw at the roll locking hole 470. The fin unit 445 is rotated to the desired roll angle. Once the desired roll angle is reached, the locking means (such as a set screw) is tightened to lock the fin unit 445 and the desired roll angle.

The yaw of the three-degree of freedom fin structure 300 is adjusted by loosening the screw at the first end cap hole 800 and at the second end cap hole 810. The fin assembly 420 then slides along the yaw track 530. The rotation (or yaw) occurs around the yaw pivot point 540. Once the desired yaw is achieved, the screw at the first end cap hole 800 and the second end cap hole 810 are tightened to lock the yaw.

The pitch of the three-degree of freedom fin structure 300 is adjusted by loosening screw at the first end cap hole 800, the screw at the second end cap hole 810, or both. Loosening these screws decreases the friction between the base plate 340, the slider assembly 410, and the middle plate 350. This allows a combination of the fin assembly 420 and the base plate 340 to slide back and forth along the pitch track 500. Once the desired pitch is achieved, the screw at the first end cap hole 800 and the second end cap hole 810 are tightened to lock the desired pitch.

The foregoing description of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description of the invention, but rather by the claims appended hereto.

What is claimed is:

1. A fin structure, comprising:

a securing means for removably securing the fin structure to an underside of a watercraft such that a fin of the fin structure is capable of guiding the watercraft through water;

a roll means for adjusting a roll of the fin to a desired roll, the roll defined as a first rotational degree of freedom about a longitudinal axis oriented along a length of the fin structure; and a yaw means for continuously and removably adjusting a yaw of the fin to a desired yaw, the yaw defined as second rotational degree of freedom about a vertical axis centered at yaw pivot point to achieve desired performance characteristics from the watercraft, the yaw means further comprising:

a yaw track disposed at an aft portion of the base plate;

a yaw pivot point disposed at a front portion of the base plate;

a rotatable fastening means for rotatably fastening the fin assembly to the base plate at the yaw pivot point such that the fin assembly can be rotated about the yaw pivot point independent of the base plate; and a slidable fastening means for fastening the fin assembly at the yaw track such that the fin assembly can slide along the yaw track when adjusting the desired yaw.

2. The fin structure of claim 1, further comprising a pitch means for adjusting a pitch of the fin to a desired pitch, the pitch defined as a translational degree of freedom along the longitudinal axis.

3. A fin structure comprising:

a securing means for removably securing the fin structure to an underside of a watercraft such that a fin of the fin structure is capable of guiding the watercraft through water;

a roll means for adjusting a roll of the fin to a desired roll, the roll defined as a first rotational degree of freedom about a longitudinal axis oriented along a length of the fin structure: and an adjusting means for adjusting another degree of freedom of the fin structure to achieve desired performance characteristics from the watercraft, the adjusting means further comprising:

a yaw means for adjusting a yaw of the fin to a desired yaw, the yaw defined as second rotational degree of freedom about a vertical axis centered at yaw pivot point;

a pitch means for adjusting a pitch of the fin to a desired pitch, the pitch defined as a translational degree of freedom alone the longitudinal axis:

a base plate having a pitch track therein;

a slider assembly disposed through the pitch track such that tabs of the slider assembly extend through a bottom of the base plate and a slider plate of the slider assembly is slidably disposed on a top of the base plate; and a fin assembly fastened to the top of the base plate over the slider assembly such that the fin assembly and base plate together are able to slide along the longitudinal axis independent of the slider assembly in order to achieve the desired pitch.

4. The fin structure of claim 3, wherein the yaw means further comprises:

a yaw track disposed at an aft portion of the base plate;

a yaw pivot point disposed at a front portion of the base plate; a rotatable fastening means for rotatably fastening the fin assembly to the base plate at the yaw pivot point such that the fin assembly can be rotated about the yaw pivot point independent of the base plate; and a slidable fastening means for fastening the fin assembly at the yaw track such that the fin assembly can slide along the yaw track when adjusting the desired yaw.

5. The fin structure of claim 4, wherein the roll means further comprises:

a middle plate having a roll track disposed thereon;

a fin unit including a fin cylinder having the fin attached thereon, the fin unit disposed on the roll track; and a fore end cap disposed on a front portion of the fin cylinder and an aft end cap disposed on an aft portion of the fin cylinder such that the fin unit is held in place and capable of rotating about the longitudinal axis to adjust the desired roll.

6. A fin apparatus for use on a watercraft, comprising:

a slider assembly having a slider plate with tabs attached at opposite ends of a bottom of the slider plate, such that the tabs are able to engage the underside of the watercraft and secure the fin apparatus;

a base plate having a pitch track with the slider assembly inserted therein such that tabs protrude from a bottom of the base plate and the slider plate is disposed on and able to slide along a top of the base plate in a forward and a backward direction along a longitudinal axis of the fin apparatus to adjust a pitch of the fin apparatus; and a fin assembly having a fin cylinder and a fin fastened on the fin cylinder to form a fin unit, the fin assembly fastened to the top of the base plate over the slider assembly such that the fin unit is able to rotate at least partially about the longitudinal axis to adjust a roll of the fin apparatus and such that the fin assembly is able to rotate at least partially about a vertical axis centered at a yaw pivot point located at a front portion of the base plate to adjust a yaw of the fin apparatus.

7. The fin apparatus of claim 6, wherein the watercraft is a surfboard.

8. The fin apparatus of claim 7, wherein the fin assembly further comprises a middle plate, comprising:

a roll track including a groove in a top of the middle plate wherein approximately half a thickness of the fin cylinder is disposed in the roll track such that the fin unit can rotate therein; and a pitch void including a cut out of a portion of a bottom of the middle plate that allows the middle plate to fit over the slider assembly and be fastened to the base plate and still allow the slider assembly to be able to slide along the top of the base plate.

9. The fin apparatus of claim 8, further comprising:

a fore end cap that fastens to a forward portion of a top of the middle plate such that the fore end cap covers a portion of a forward portion of the fin cylinder; and an aft end cap that fastens to a back portion of the top of the middle plate such that the aft end cap covers a portion of a back portion of the fin cylinder.

10. The apparatus of claim 9, wherein the base plate further comprises a yaw track that includes a cut-out in the base plate in which an aft portion of the fin assembly slides to adjust the yaw.

11. The apparatus of claim 10, wherein the base plate further comprises a fore access void and an aft access void that are used to access removable fastening means that secure the fin apparatus to the surfboard.

12. The apparatus of claim 9, wherein the fore end cap further comprises a roll locking hole that allows access to a locking means.

13. The apparatus of claim 12, wherein the locking means further comprises a set screw that can be tightened or loosened using the roll locking hole to either lock or unlock the fin unit to adjust the roll of the fin apparatus.

* * * * *